United States Patent [19]

Farran et al.

[11] Patent Number: 4,510,841

[45] Date of Patent: Apr. 16, 1985

[54] MECHANISM FOR CUTTING SINGLE THICKNESS PAPER OR LIKE SHEET MATERIAL AND APPARATUS INCLUDING SUCH MECHANISM

[75] Inventors: John Farran; Michael R. Hatchett, both of Eastleigh; John S. Heath, Winchester, all of England

[73] Assignee: International Business Machines Corporation, Armonk, N.Y.

[21] Appl. No.: 560,083

[22] Filed: Dec. 9, 1983

[30] Foreign Application Priority Data

Dec. 10, 1982 [EP] European Pat. Off. ..... 82306596.6

[51] Int. Cl.[3] ..... B26D 1/30

[52] U.S. Cl. ..... 83/176; 83/582; 83/584; 83/694

[58] Field of Search ..... 83/176, 582, 583, 584, 83/585, 17, 651, 694, 679

[56] References Cited

U.S. PATENT DOCUMENTS

| | | | |
|---|---|---|---|
| 938,741 | 11/1909 | Campbell | 83/585 X |
| 1,565,654 | 12/1925 | Laukhuff | 83/582 X |
| 1,894,379 | 1/1933 | Link | 83/585 X |
| 2,382,406 | 8/1945 | Engberg | 83/176 X |
| 3,353,432 | 11/1967 | Philippi | 83/176 |
| 3,757,621 | 9/1973 | Breetvelt | 83/694 X |
| 3,799,022 | 3/1974 | Nagel et al. | 83/694 X |

*Primary Examiner*—Donald R. Schran
*Attorney, Agent, or Firm*—Earl C. Hancock

[57] ABSTRACT

A paper shear mechanism consists of a guillotine having a fixed blade and a pivoted blade. The cutting edge of the fixed blade is concavely curved so that paper to be cut as fed between the blades assumes a corresponding curvature and is given some longitudinal rigidity during the cutting operation. The pivoted blade is of composite structure to simplify the manufacturing process and thus reduce cost. Essentially, it includes a cutting section stamped from flexible sheet steel shim to provide a cutting edge with the desired nip angle. The flexible steel section is spot welded to a mild steel backing member with an elongated spring member sandwiched between the two. The spring member has a number of spring teeth which exert a force along the length of the flexible section to deflect its cutting edge laterally towards the fixed blade. By this means contact between the cutting edges is maintained along the length of a cut and relief between the facing surfaces of the two blades is provided. A sheet feeding apparatus with a correspondingly curved cross-section to the fixed blade feeds paper web to the shear mechanism. A single motor serves to feed paper during forward rotation and to operate the paper shear during reverse rotation.

10 Claims, 9 Drawing Figures

FIG. 5
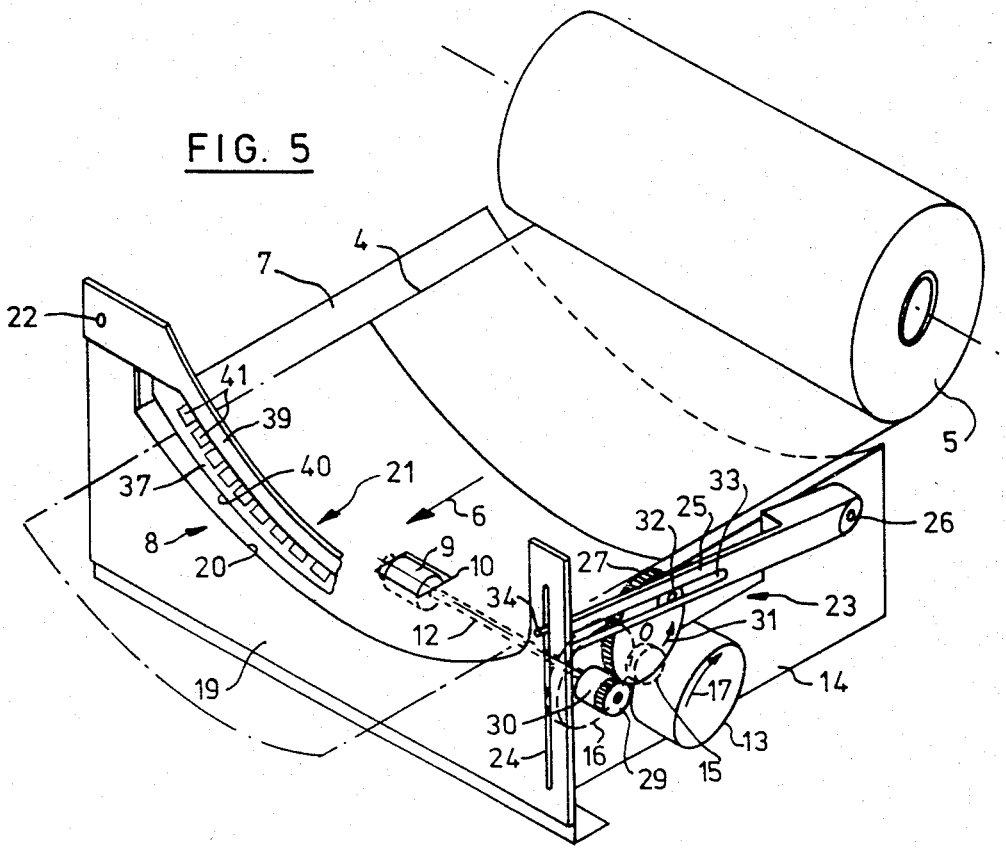
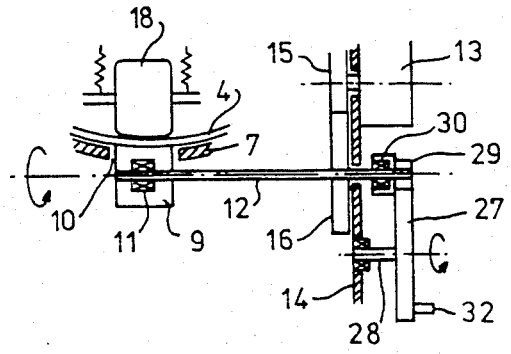
FIG. 6

MECHANISM FOR CUTTING SINGLE THICKNESS PAPER OR LIKE SHEET MATERIAL AND APPARATUS INCLUDING SUCH MECHANISM

This application claims priority under 35 USC 119, based upon European application Ser. No. 82306596.6 filed Dec. 10, 1982.

BACKGROUND OF THE INVENTION

1. Field of the Invention

The invention relates to a mechanism for cutting single thickness paper and like sheet material and is of the kind having a pivoted blade which cooperates during the cutting operation with a fixed blade. The invention further relates to sheet feeding apparatus, such as may be incorporated, for example, in printers and copiers, where such a mechanism is included for cutting individual sheets of paper from continuous stock.

2. Description of the Prior Art

The requirements for successful cutting of paper or like materials are well understood, and can conveniently be explained using the blade design of the familiar domestic scissor as an example. During the following brief explanation, reference will be made to FIGS. 1 to 4 of the accompanying drawings which illustrate the various desirable characteristics of scissor blades.

The action of cutting sheet material by shearing is illustrated in FIG. 1 where two sharp blades 1 and 2 are shown applying a transverse shear stress to the material 3. In order to minimize the force required to sever the material, scissor blades 4 and 5, shown in FIG. 2, are curved along their lengths so that cutting is progressive from point to point along the line of cut as the blades close. Preferably, the curvature of the blades are such that they present a constant nip angle ($\alpha$) to the material along the entire blade length. It is also a requirement that the cutting edges of the blades touch each other only at the point of shearing the material. This involves a further curve along the length of each blade 4 and 5 as shown in FIG. 3 and also relief of the facing surfaces of the blades as shown in FIG. 4.

The manufacture of blades with such complex forms in hardened steel is still largely a hand craft and consequently is an expensive operation.

GB No. 2,051,652A describes a guillotine of the type commonly used in offices for trimming paper in which a pivoted cutting blade cooperates with a fixed cutting blade. In this particular construction of guillotine, the cutting portion of the pivoted blade is formed from substantially rigid sheet material. During the cutting operation, the rigid blade is supported by being sandwiched between the fixed blade member and a rigid backing member to which the sheet material is attached. By this means, the cutting edge of the pivoted blade is restrained from moving laterally away from the fixed blade during cutting operations.

To improve the cutting action of this guillotine, the side face of the rigid backing member may be slightly concavely curved or alternatively the cutting blade may have its ends fixed to the backing member so that the intermediate portion of the blade is flexed outward to some extent away from the backing member toward the fixed blade. Additional restraining means comes into operation during the act of cutting positively to prevent the cutting edges from moving sideways out of contact with each other.

This guillotine has a composite blade construction which is claimed to be less costly than the more usual guillotine in which both blades are formed from heavy gauge tempered steel plate. However, the guillotine is intended not only for trimming single sheets of material, but also for cutting through a stack of sheets and is therefore rugged in construction and heavy in design.

DISCLOSURE OF THE INVENTION

It is an object of the present invention to provide apparatus including a low cost shear mechanism which is capable of repetitive operation to cut a continuous sheet of paper, or like material, fed from a roll into a plurality of individual sheets.

It is a further object of the invention that the shear mechanism shall be of simple construction but one which ensures that each cut made is straight and clean.

It is a further object of the invention that the moving parts of the mechanism shall be capable of being driven by a motor and constructed with low mass in order to minimize the demands on the motor.

According to the invention, a mechanism for cutting single thickness paper or like sheet material comprises a fixed blade and a pivoted blade, wherein the pivoted blade has a cutting member blanked from sheet steel to a shape that gives a desired nip angle along the length of the cut and is supported on a rigid backing member, characterized in that elongated spring biasing means is located between the blanked cutting member and the rigid backing member to impart a lateral force to the blanked cutting member along its length, the blanked cutting member being sufficiently flexible, and the construction and arrangement of the spring biasing means in relation to the blanked cutting member being such that the cutting edge of the cutting member is resiliently deflected towards the fixed member along its length whereby contact between the cooperating cutting edges is maintained along the length of the cut and relief between the facing surfaces of the blades is provided during a cutting operation.

BRIEF DESCRIPTION OF THE DRAWING

In order that the invention shall be fully understood a preferred embodiment thereof will now be described with reference to the accompanying drawings, in which:

FIG. 5 shows a sheet feeding apparatus including a paper shear mechanism according to the invention.

FIG. 6 shows schematically a detail of the drive mechanism of the machine shown in FIG. 5.

DETAILED DESCRIPTION OF THE PREFERRED EMBODIMENT

Figure 1:
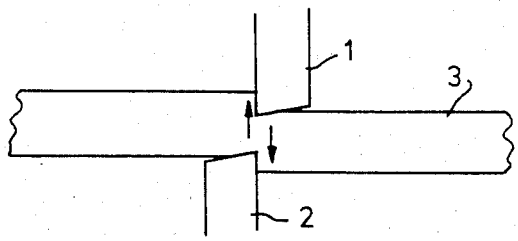
FIGS. 1–4 illustrate various characteristics of scissor blades as described above.
Figure 2:
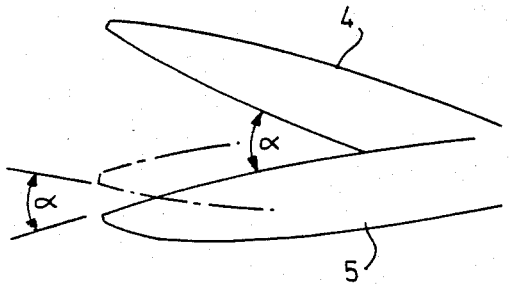
Figure 3:
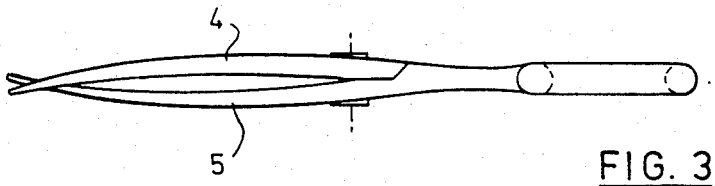
Figure 4:
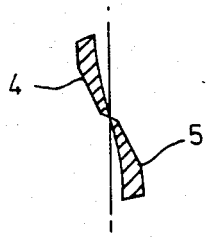

FIG. 5 shows apparatus for feeding paper web 4 from a roll 5 in a feed direction indicated by arrow 6 along a feed bed 7 to a paper shear mechanism, indicated generally by arrow 8. The shear mechanism is shown cut away in FIG. 5 to expose a friction paper feed roller 9 projecting through an aperture 10 in the feed bed 7. The feed bed 7 is concavely-curved across its width into an arc of a circle so that, as paper web 4 is advanced from the roll 5 onto the feed bed, it is formed into a ninety-degree quadrant. The curvature imparted to the paper gives it longitudinal stiffness which, since the paper is self supporting as it leaves the feed bed, aids cutting operations subsequently performed by the shear mechanism 8.

The feed roller 9 is carried by a roller clutch 11, mounted on a drive spindle 12 and driven from stepping motor 13 attached to side wall 14 of the apparatus, through speed reduction gears 15 and 16. A detail of the the drive coupling is shown in FIG. 6. The clutch 11 operates to rotate the friction feed roller 9 only in the paper feed direction 6 in response to forward clockwise rotation of the motor 13, indicated by arrow 17, and to decouple the roller from its drive spindle during reverse anti-clockwise rotation of the motor. A spring-loaded pinch roller 18 mounted above the feed bed cooperates with the feed roller 9 during forward feed to advance the paper web 4 therebetween in the feed direction 6.

The shear mechanism 8 is in the form of a guillotine having a fixed lower blade 19 with a concavely-curved cutting edge 20 which conforms to the circular shape of the feed bed 6, and a composite moving blade 21, a component part of which is pivotally attached at one end to the fixed blade by pivot pin 22. To manufacture, the arcuate surface of the fixed blade is sheared and then the blade hardened and ground by low cost conventional manufacturing methods on the cutting face only. The cutting face is defined as that face of the fixed blade disposed towards the moving blade.

The cutting action of the guillotine blades 19 and 21 is controlled by a slider-crank mechanism, shown generally as 23 in FIG. 5, which is coupled to the other end of the moving blade through a vertical slot 24 in an extended side portion of the fixed blade 19. The mechanism 23 consists of a crank 25, attached at one end to the side wall 14 by pivot pin 26, driven by a bull wheel 27, rotatably mounted on a spindle 28 extending from side wall 14. The bull wheel 27 is itself driven by a gear 29 coupled to drive spindle 12 through roller clutch 30. The clutch 30 operates to rotate the bull wheel 27 only in the direction indicated by arrow 31, that is, in response to anti-clockwise rotation of the motor 13. By means of the coupling between the pin 32 on bull wheel 27 sliding in a slot 33 of crank 25, the rotary anti-clockwise motion of the motor 13 is converted to reciprocal up and down motion of a shear drive pin 34 extending from the crank 25. The drive pin 34 protrudes through slot 24 and is coupled to the free end of the pivoted blade 21 by means of a sliding bush 36 through which the drive is transmitted to the blade 21.

By using the two one-way clutches 11 and 30 in the manner described, the single motor 13 serves the dual function of paper feed during clockwise rotation, and paper shear during anti-clockwise rotation. The gearing of the paper feed mechanism is chosen so that the desired length of paper is fed in response to a predetermined number of revolutions of the motor 13. Clearly, since each paper feed operation can only occur when the blades of the cutting mechanism are open, it is arranged for each paper shear cycle to end with the pivoted blade 20 returned to its upper position. Accordingly, during the paper shear cycle, the motor 13 causes the bull wheel 27 to rotate through one complete revolution, starting with the wheel in the top dead center position with the pin 32 uppermost. The gearing is such that the cut made by the shearing action of the blade 21 cooperating with blade 19 occurs during the first half of the revolution and at the time the mechanical advantage of the mechanism is greatest.

Figure 7:
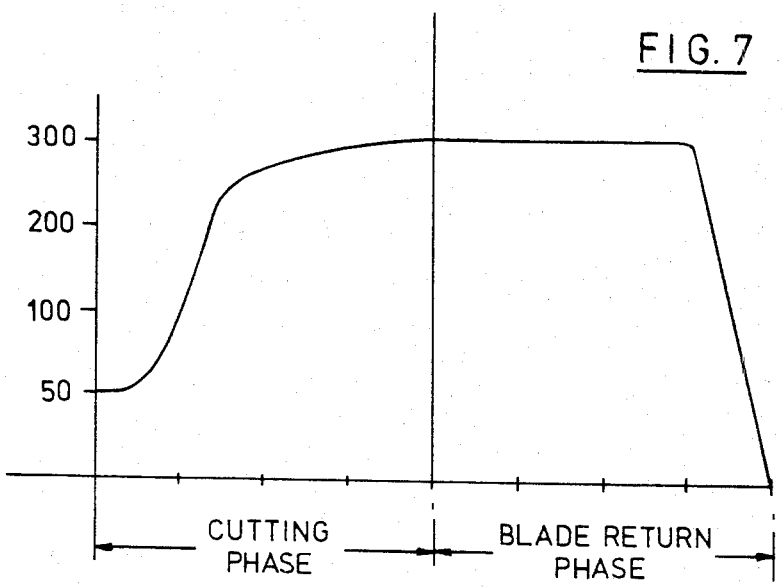
FIG. 7 shows a speed profile during a paper shear cycle of a step motor used to drive the shear mechanism.

Control of rotation of the motor during paper feed and paper shear is primarily by step counting. A typical step motor speed profile during a shear cycle is shown in FIG. 7. Use of a stepping motor in this application makes it a simple matter to profile the speed during the cutting cycle so that the torque characteristics of the motor are matched to the varying drive torque demanded by the changing load and mechanical advantage of the shear.

The use of sensors provide an alternative to this method of control. Thus, a sensor may be provided to indicate to control circuitry when, for example, the bull wheel has returned to top dead center and a new shear operation may be initiated. A further sensor may be employed to measure the number of revolutions of the drive spindle 12 and thus the web feed distance.

Figure 8:
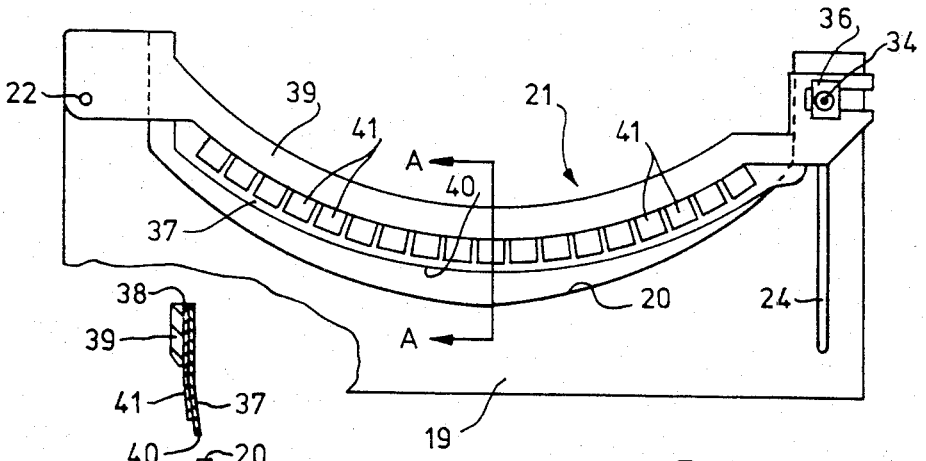
FIG. 8 shows the detailed construction of the shear mechanism forming part of the machine in FIG. 5.
Figure 9:
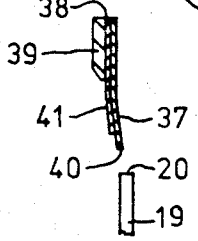
FIG. 9 shows a section of the mechanism taken along the line A—A in FIG. 8.

The details of construction of the composite moving blade 21 are shown in FIGS. 8 and 9. The blade is formed in three parts viz: a cutting section 37; a comb-like spring member 38; and a rigid backing plate 39. The cutting section 37 is blanked from pre-hardened and tempered polished steel shim stock. No finishing operation is required. A cutting edge 40 of section 37 is formed to a shape that will give a constant nip angle of approximately six degrees all across the cut. This nip angle is the minimum that has been found to be free from locking problems. Determining the precise form that the cutting section 37 should take is a complex exercise in geometry. However, since the section is blanked rather than cut, this is of no consequence to the manufacturing cost.

The comb-like spring member 38 has a plurality of spaced-apart teeth 41 extending along its length from a common backing strip. The spring member 38 is preformed with the teeth 41 bent sideways from the backing strip by predetermined amounts. The arrangement is such that when assembled with the spring member 38 sandwiched between the cutting section 37 and backing plate 39 to form the composite blade 21, the teeth 41 bear along the length of the flexible cutting section 37 and deflect its cutting edge 40 sideways toward the cutting edge 20 of the fixed blade 19. The backing plate 39 is of mild steel, and the spring member 38 and cutting section 37 are attached to it by spot welds at intervals along its length. The backing plate 39 has the same general curvature as the cutting edge 40 and is the previously referred to component part of the moving blade 21 which is pivoted at one end to the fixed blade by pivot 22, and driven at the other end by the slider-crank mechanism 23 through the shear drive pin 34 and bush 36.

The contact force between the moving blade 21 and the fixed blade 19 along the length of the cut is determined by the forces applied by the individual teeth 41 of the spring member 38 to the flexible cutting section 37. The setting of the forces can of course be varied from tooth to tooth as required so that contact between the cutting edges 20 and 40 is maintained along the length of the cut and relief between the facing surfaces of the blades is provided during cutting operation.

Although the present invention is described herein with particularity relative to the foregoing detailed description of an exemplary embodiment, various modifications, changes, additions, and applications of the present invention in addition to those mentioned herein will readily suggest themselves to those having normal skill in the art without departing from the spirit of this invention.

What is claimed is:

1. In a mechanism for cutting single thickness paper or like sheet material including a fixed blade and a pivoted blade, the pivoted blade having a cutting member blanked from sheet steel to a shape that provides a cutting edge that gives a desired nip angle along the length of the cut and is supported on a rigid backing member, an improvement comprising an elongated spring biasing means located between the blanked cutting member and the rigid backing member to impart a lateral force to the blanked cutting member along its length, the blanked cutting member being sufficiently flexible, and the construction and arrangement of the spring biasing means in relation to the blanked cutting member being such that the cutting edge of the cutting member is resiliently deflected towards the fixed member along its length whereby contact between the cooperating cutting edges is maintained along the length of the cut and relief between the facing surfaces of the blades is provided during cutting operations.

2. A mechanism as claimed in claim 1, in which the elongated spring biasing means comprises a comb-like spring member having a plurality of spaced apart teeth extending from a common backing strip, the backing strip being sandwiched between the blanked cutting member and the rigid backing member with the teeth extending towards the cutting edge of said cutting member, and being preset to bear along the length of said cutting member in order resiliently to deflect said cutting edge as aforesaid.

3. A mechanism as claimed in claim 1, in combination with web feeding apparatus having a feed bed along which, in use, a web of paper or like material is fed, said feed bed having a concavely curved cross-section transverse to the direction of feed, and said fixed blade having a cutting edge the curvature of which corresponds to the curvature of said feed bed.

4. A combination as claimed in claim 3, in which said feeding apparatus includes web feeding means operable when driven by a motor, when rotating in a first direction only, to feed a web along said feed bed in the intended feed direction.

5. A combination as claimed in claim 4, in which said feeding apparatus includes a rotary to reciprocal motion converter connected to convert rotary motion of said motor to reciprocal motion of said pivoted blade, said converter being operable only when driven by said motor when rotating in a second direction opposite to said first direction.

6. A combination as claimed in claim 5, including control means for controlling said motor to operate repetitively in first and second successive cycles, said first cycle commencing at a time when said blades are open and causing said motor to rotate in said first direction, whereby, in use, a predetermined length of web is advanced along said feed bed, and said second cycle causing said motor to rotate in said second direction to operate said converter to cut the length of web fed between the blades during the immediately preceding first cycle, and to leave the blades open.

7. A mechanism as claimed in claim 2, in combination with web feeding apparatus having a feed bed along which, in use, a web of paper or like material is fed, said feed bed having a concavely curved cross-section transverse to the direction of feed, and said fixed blade having a cutting edge the curvature of which corresponds to the curvature of said feed bed.

8. A combination as claimed in claim 7, in which said feeding apparatus includes web feeding means operable when driven by a motor, when rotating in a first direction only, to feed a web along said feed bed in the intended feed direction.

9. A combination as claimed in claim 8, in which said feeding apparatus includes a rotary to reciprocal motion converter connected to convert rotary motion of said motor to reciprocal motion of said pivoted blade, said converter being operable only when driven by said motor when rotating in a second direction opposite to said first direction.

10. A combination as claimed in claim 9, including control means for controlling said motor to operate repetitively in first and second successive cycles, said first cycle commencing at a time when said blades are open and causing said motor to rotate in said first direction, whereby, in use, a predetermined length of web is advanced along said feed bed, and said second cycle causing said motor to rotate in said second direction to operate said converter to cut the length of web fed between the blades during the immediately preceding first cycle, and to leave the blades open.

* * * * *